United States Patent [19]

Gatward

[11] Patent Number: 4,677,684

[45] Date of Patent: Jun. 30, 1987

[54] BAG FOR A FOOD PRODUCT

[76] Inventor: Douglas K. Gatward, 1212 Great Cambridge Rd., Enfield, Middlesex, England

[21] Appl. No.: 861,106

[22] Filed: May 6, 1986

Related U.S. Application Data

[63] Continuation of Ser. No. 657,770, Oct. 4, 1984.

[51] Int. Cl.[4] ..... B65D 33/24

[52] U.S. Cl. ..... 383/87; 383/907

[58] Field of Search ..... 383/87, 907; 229/DIG. 13

[56] References Cited

U.S. PATENT DOCUMENTS

| | | | |
|---|---|---|---|
| 578,243 | 3/1897 | Keith | 383/87 |
| 3,256,976 | 6/1966 | Greason | 383/87 |
| 3,405,863 | 10/1968 | Kugler | 383/907 |
| 3,503,759 | 3/1970 | Wilton | 229/DIG. 13 |
| 3,512,700 | 5/1970 | Evans et al. | 383/907 |
| 3,960,314 | 6/1976 | Faierg | 383/87 |
| 4,211,267 | 7/1980 | Shovgaard | 383/87 |
| 4,273,249 | 6/1981 | Florian | 229/DIG. 13 |
| 4,332,347 | 6/1982 | Clayton | 383/87 |

*Primary Examiner*—Stephen P. Garbe
*Attorney, Agent, or Firm*—Darby & Darby

[57] ABSTRACT

A bag for holding a generally circular product formed by two sheets of material which are joined along the side and bottom edges thereof leaving the top edges open to accept the product. The bottom corners of the bag are curved and a flap is attached to one of the sheets along its top edge with curved seams so that when the flap is folded over, the corners at the top edges are also curved. In one embodiment, the flap is generally rectangular and is also attached to said one sheet in areas outside of the curved seams.

7 Claims, 4 Drawing Figures

BAG FOR A FOOD PRODUCT

This is a continuation of application Ser. No. 657,770, filed Oct. 4, 1984.

This invention relates to a bag for a generally circular food products, in particular a hamburger, for packing the product at point of sale.

Conventionally, fast food product such as hamburgers are packaged either by being wrapped in sheet material or, more recently, by being placed in light-weight plastic boxes with hinged lids. The sheet wrapping materials have the advantage that they are compact in storage, but they are troublesome to apply to the goods and can yield untidy, insecure packages. The boxes are highly successful, generally being constructed of light-weight insulating foamed polystyrene, but they are bulky to store. There is a need for a simple package for circular food products, such as hamburgers, which preferably provide a degree of insulation, which provide a neat package which is easily applied to the goods, and which can be stored in a minimum of space.

The present invention relates to a bag that fulfills all of these requirements and can be cheaply and easily produced.

According to the present invention, there is provided a bag for a generally circular food products comprising two superimposed sheets bonded together or integrally joined along side and bottom edges and open along top edges. The first of the sheets has an outwardly and downwardly folded flap portion superimposed on it defining a top edge to said sheet along the fold line, side edges of the flap portion being bonded to the side edges of the superimposed sheets. The bottom corners of the first and second sheets are rounded and rounded seams are provided to join the flap to the first sheet. Accordingly, when the product is placed within the bag and the flap folded over, a substantially round pocket is formed to hold the product.

In a preferred embodiment, the second of the two sheets comprising the bag extends upwardly beyond the top edge defined by the fold line of the first sheet to provide a small margin. This margin is helpful when inserting the hamburger into the bag.

It will be seen that the bag according to this invention is an improvement over the captive flap bag now well-known in the packaging industry, working on the pillowcase-fastening principle. The bag according to the present invention is particularly shaped and constructed to produce a particular desired shape when filled with the product being packaged.

A specific embodiment of the bag according to the invention is now described with reference to the accompanying drawings in which.

The bag is constructed of superimposed upper and lower sheets 1 and 10 material with rounded bottom corners bonded together along the sides and bottom to form a pocket with an open top. The sheets 1 and 10 may be made of any suitable material. One preferred material is easily weldable thermoplastic film material, for example poly-alkylene film. However, as a degree of thermal insulation is desirable, a more preferred material is a thin film of foamed polyethylene or the like.

Where foamed polyethylene is used, it can be of a thickness of 15–150 microns and preferably about 75 microns. Alternative materials include paper, paper/plastic laminates, etc.

Figure 1:
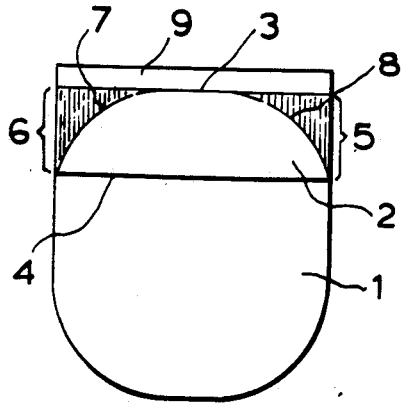
FIG. 1 is a plan view of an empty bag.
Figure 2:
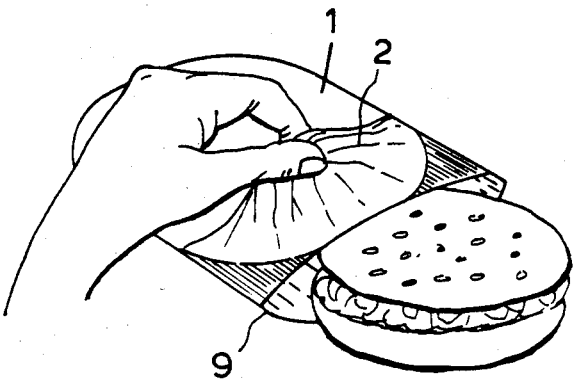
FIG. 2 is a perspective view of the bag being filled.

With reference to FIG. 1, the top sheet includes a separate downwardly folded flap portion 2 having a top edge 3 and a bottom straight edge 4. Flap 2 is preferably generally rectangular and two curved weld seams 7 and 8 fasten the flap 2 to the upper sheet 1 between the sides of its bottom edge 4 and the center of its top edge 3. The side portions of the flap 2 outside of the weld seams are bonded together with the bag top sheet in areas generally marked 5 and 6 for added strength. As seen in FIG. 2 the flap can be folded toward the top opening 14 about seams 7 and 8 and top edge 3 by pulling free edge 4 toward the opening.

The dimensions of the bag can be adapted to suit the size of the intended food product, but a typical hamburger bag will be about 14 cms or 5.5 inches wide. Each of the superimposed sheets has a width approximately equal to its depth and has rounded bottom corners, the radius of curvature of said corners preferably being about 0.25 to 0.50 times the depth of the bag from folded top edge to bottom, the ratio of the flap portion to said depth of the bag being from about 1:3 to about 1:5. The flap portion of the said first sheet is bonded to the sheet to which it is attached along quadrant shaped seams 7, 8 having a similar radius of curvature to that of the bottom corners, said quadrant shaped seams joining the side edges of the bottom end of the flap portion to the folded top edge such that when the flap portion is inverted over the open top edges of the bag, a closed bag having four rounded corners is formed.

The relationship of the radius of curvature of the rounded bottom corners and round flap seams 7,8 to the depth of the bag, as defined above, is important to the successful construction of the bag, as is the relationship of the flap depth to the overall bag depth. Unless the dimensions are within the ranges stated, the bag cannot be folded over a typical hamburger product without undue puckering or distortion. For a bag of this type to be acceptable to the buying public, it must, when containing a hamburger or the like, present a smooth rounded external appearance simiilar to that of the typical polystyrene box hamburger container.

The radius of curvature of seams 7 and 8 is generally similar to the radius of curvature of the bottom corners of the bag and is conveniently about 0.3 to 0.4 times the depth of the bag from folded edge 3 to the bottom. For a typical hamburger, the distance from flap fold line 3 to the bottom of the bag is about 15 cms or 5.75 ins and the radius of curvature is about 5 to 6 cms. The ratio of the depth of the flap 2 to the overall length of the bag is about 1:3.5 to 1:4.25, typically about 1:3.75. For a bag of length 15 cms, a flap lenth of 4 cms is preferred.

The bag lower sheet 10 is also preferably provided with an upstanding margin 9 formed by an extension of the bottom sheet beyond the flap fold line 3. This margin 9 can be adapted to be severably connected to a stub portion when bags are mounted in a pad and are torn or snapped off from a stationary piece.

Figure 3:
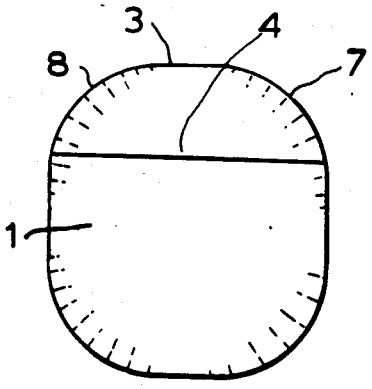
FIG. 3 is a plan view of the bag containing a hamburger, the flap having been inverted over the opening.
Figure 4:
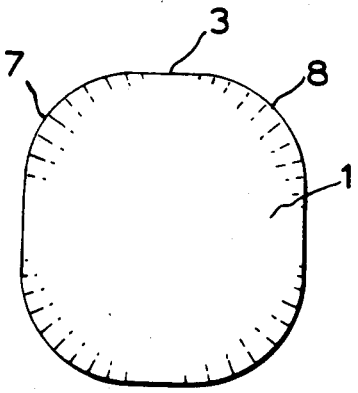
FIG. 4 shows a bottom view of the bag in FIG. 3.

As shown in FIG. 2, lifting the flap 2 while bearing down on the margin 9 the bag is opened and the hamburger easily slipped into it. The bag is then sealed by inverting the flap 2 over the open end of the bag to give the appearance shown in FIG. 3 and 4. Due to the curved corners at the bottom of the bag and the curvatures of seams 7 and 8, the finally packed bag conforms to the shape of the hamburger.

In another embodiment (not shown) the area of bag outside the seams 7,8 can be trimmed to a curve below edge 3, to give an arch-topped bag.

What is claimed is:

1. A bag for a generally circular food product comprising:

upper and lower flat sheets of material each having four sides defining respective top, bottom and two side edges and joined together along their side and bottom edges and open along their top edges, the juncture portions of said bottom and side edges of said sheets being curved to generally correspond to the shape of the product to be contained with the bag, each side edge having a liner region extending from the end of the (terminus of the) curved portion on the side edge towards its top edge, a flat flap having four sides defining top, bottom and two side edges fastened to one of said sheets, the flap top edge fastened to said one sheet adjacent its top edge and each of its side edges fastened to said one sheet along a curved seam between the top and bottom edges of the flap, each curved seam having a shape similar to but lying in a direction opposite to said curved portions of the bottom of the bag with the end of each said curved seam terminating at the bottom of the flap at the linear region of the corresponding side edge of said one sheet, said flap having its bottom edge free to be inverted over the top edge of the other sheet to fold along its top edge and said curved seams to form a product holding pocket defined by said two curved portions, said two curved seams and said linear regions of said side edges.

2. A bag as in claim 1 wherein each sheet has a width approximately equal to its depth, the radius of curvature of said curved portions being about 0.25 to 0.50 times the depth of the bag from folded top edge to bottom edge of said one sheet, the ratio of the depth of the flap to said depth of the bag being from about 1:3 to about 1:5.

3. A bag as in claim 1 wherein the flap is bonded to said one sheet along quadrant shaped seams having a similar radius of curvature to said curved portions.

4. A bag as in claim 2 wherein the flap is bonded to said one sheet along quadrant shaped seams having a similar radius of curvature to the curved portions at the bottom of the bag.

5. A bag according to claim 1 wherein said sheets are of foamed polyethylene film.

6. A bag according to claim 1 in which the other sheet extends beyond the said flap fold line as a projecting margin.

7. A bag as in claim 1 wherein each side edge of said one sheet is (has a) linear from the end of the curved portion up (side edge region extending upwardly) to its top edge, the area of said flap outside each said curved seam also being bonded to said one sheet.

* * * * *